US011168592B2

(12) United States Patent
Wicks

(10) Patent No.: US 11,168,592 B2
(45) Date of Patent: Nov. 9, 2021

(54) VARIABLE VALVE ACTUATION SYSTEM

(71) Applicant: Ford Global Technologies, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 108 days.

(21) Appl. No.: 16/287,153

(22) Filed: Feb. 27, 2019

(65) Prior Publication Data

US 2020/0271022 A1 Aug. 27, 2020

(51) Int. Cl.
*F01L 9/02* (2006.01)
*F01L 9/14* (2021.01)

(52) U.S. Cl.
CPC ..... *F01L 9/14* (2021.01)

(58) Field of Classification Search
CPC ... F01L 9/025; F01L 9/021; F01L 9/02; F01L 9/00; F01L 1/00; F01L 1/053; F01L 1/20; F01L 1/24
USPC ..... 123/90.12, 90.1, 90.39, 90.33, 90.55, 123/90.13
See application file for complete search history.

(56) References Cited

U.S. PATENT DOCUMENTS

| | | | | |
|---|---|---|---|---|
| 8,020,526 | B2 * | 9/2011 | Rauch | F01L 9/025 123/90.12 |
| 2004/0055547 | A1 * | 3/2004 | Diehl | F01L 9/02 123/90.12 |
| 2008/0178828 | A1 * | 7/2008 | Patel | F01L 13/0031 123/90.12 |
| 2013/0019831 | A1 * | 1/2013 | Yamazaki | F01L 1/185 123/90.39 |
| 2016/0363012 | A1 * | 12/2016 | Beyer | F01L 1/18 |
| 2017/0101909 | A1 * | 4/2017 | Beyer | F01M 11/0004 |

FOREIGN PATENT DOCUMENTS

| | | |
|---|---|---|
| DE | 102012221354 A1 | 1/2013 |
| DE | 102014219736 A1 | 3/2016 |
| DE | 102016124918 A1 | 6/2018 |

* cited by examiner

*Primary Examiner* — Charles G Freay
*Assistant Examiner* — Kelsey L Stanek
(74) *Attorney, Agent, or Firm* — Geoffrey Brumbaugh; McCoy Russell LLP

(57) ABSTRACT

Methods and systems are provided for variable valve actuation assembly. In one example, the variable valve actuation assembly may include a first pressure reservoir with a first pressure fluidly coupled to valve actuators and positioned below an engine valve. A second pressure reservoir with a second pressure is arranged directly below the first pressure reservoir and a hydraulic medium flows between the first and second pressure reservoirs.

20 Claims, 8 Drawing Sheets

VARIABLE VALVE ACTUATION SYSTEM

FIELD

The present description relates generally to an internal combustion engine including a variable valve actuation.

BACKGROUND/SUMMARY

Engine performance may be affected by a timing of a valve lift. In an internal combustion engine, actuation of intake and exhaust valves controls introduction of air into engine cylinders and regulates removal of exhaust gas from the cylinders, thereby moderating an amount of torque generated by combustion to power motion of a vehicle. However, maintaining a uniform timing of valve lift, e.g., when intake and exhaust valves are lifted relative to one another and to engine operations, may not accommodate changes in engine operating conditions. For example, at high engine speeds, prolonging a lift duration of the intake valves may increase an amount of air entering the cylinders, thereby increasing a power output and performance of the engine. Decreasing the duration of the intake valves at lower engine speeds to decrease overlap with the exhaust valves may reduce emissions and increase a fuel economy of the engine. Invariable valve lift timing may result in overall poor power output and fuel efficiency.

Adjustment of valve lift timing may be enabled by adapting the engine with a variable valve actuation system, such as variable timing or variable lift. In particular, continuous variable valve actuation system, enabling adjustment of both lift height and lift timing, allows valve actuation to be optimized to all engine speeds and conditions. One example of a continuous valve lift system is shown by Ruach et al. in U.S. Pat. No. 8,020,526. Therein, a hydraulic unit for a cylinder head of an internal combustion engine with a hydraulic, variable valve train is provided. Valve lift is controlled by hydraulic pressure provided by a hydraulic medium. The hydraulic unit includes a high-pressure chamber, a medium-pressure chamber, and a low-pressure chamber that is used as a hydraulic fluid reservoir. The high-pressure chamber is coupled to a region of the hydraulic unit between a master unit and a slave unit, the units acting on poppet valves to actuate lift, and acts as a hydraulic link between the master and slave units. The hydraulic unit may be coupled to the cylinder head, arranged between the poppet valves and a cam. Thus, continuously variable valve lift is enabled based on regulation of hydraulic pressure in the unit.

However, the inventors herein have recognized potential issues with such systems. As one example, the coupling of the high-pressure chamber to the master and slave units results in a positioning of the high-pressure chamber proximate to the poppet valves. In order to maintain the high-pressure chamber near the poppet valves, the hydraulic unit may include a base plate in which the high-pressure chamber is arranged as well as at least one of a lower pressure chamber, such as the medium-pressure chamber and/or the low-pressure chamber. The lower pressure chamber may be arranged adjacent to the high-pressure chamber, thereby increasing a footprint of the hydraulic unit with respect to a width, along a horizontal axis, of the hydraulic unit. The footprint of the hydraulic unit may exacerbate tight packaging constraints within an engine compartment of a vehicle. Furthermore, the high-pressure chamber may be partially disposed in the cylinder head to accommodate a volume of the high-pressure chamber when the high-pressure chamber volume exceeds a volume that may be incorporated into the hydraulic unit base plate. An extension of the high-pressure chamber volume into the cylinder head may form cavities in the cylinder head that complicates manufacturing of the cylinder head and may incur additional costs due to the more complex geometry.

In one example, the issues described above may be addressed by a variable valve actuation (VVA) assembly, including a plurality of actuators to adjust a lift height and duration of engine valves, a first fluid chamber, having a first pressure, arranged vertically below the engine valves and the plurality of actuators and fluidly coupled to the plurality of actuators, and a second fluid chamber, having a second pressure, positioned directly below the first chamber and coupled to the first fluid chamber by a channel. In this way, variable valve actuation is achieved while reducing a footprint of the assembly.

As one example, both the higher pressure reservoir and the lower pressure reservoir may be disposed within a housing of an electro-hydraulic unit. The higher pressure reservoir may be stacked vertically above the lower pressure reservoir, integrated into an upper portion of the housing. The lower pressure reservoir may be included in a lower portion of the housing, the lower portion configured to couple directly to the upper portion and the lower pressure reservoir separated from the higher pressure reservoir by a plate. The vertical stacking of the reservoirs decreases a width of the electro-hydraulic unit and maintains the cavities forming the reservoirs with the housing of the electro-hydraulic unit. In addition, the electro-hydraulic unit may be sealed and fastened to the cylinder head via a simplified system including a single set of fastening devices.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-8 are shown approximately to scale

DETAILED DESCRIPTION

The following description relates to systems and methods for a hydraulically actuated variable valve actuation system.

Figure 3:
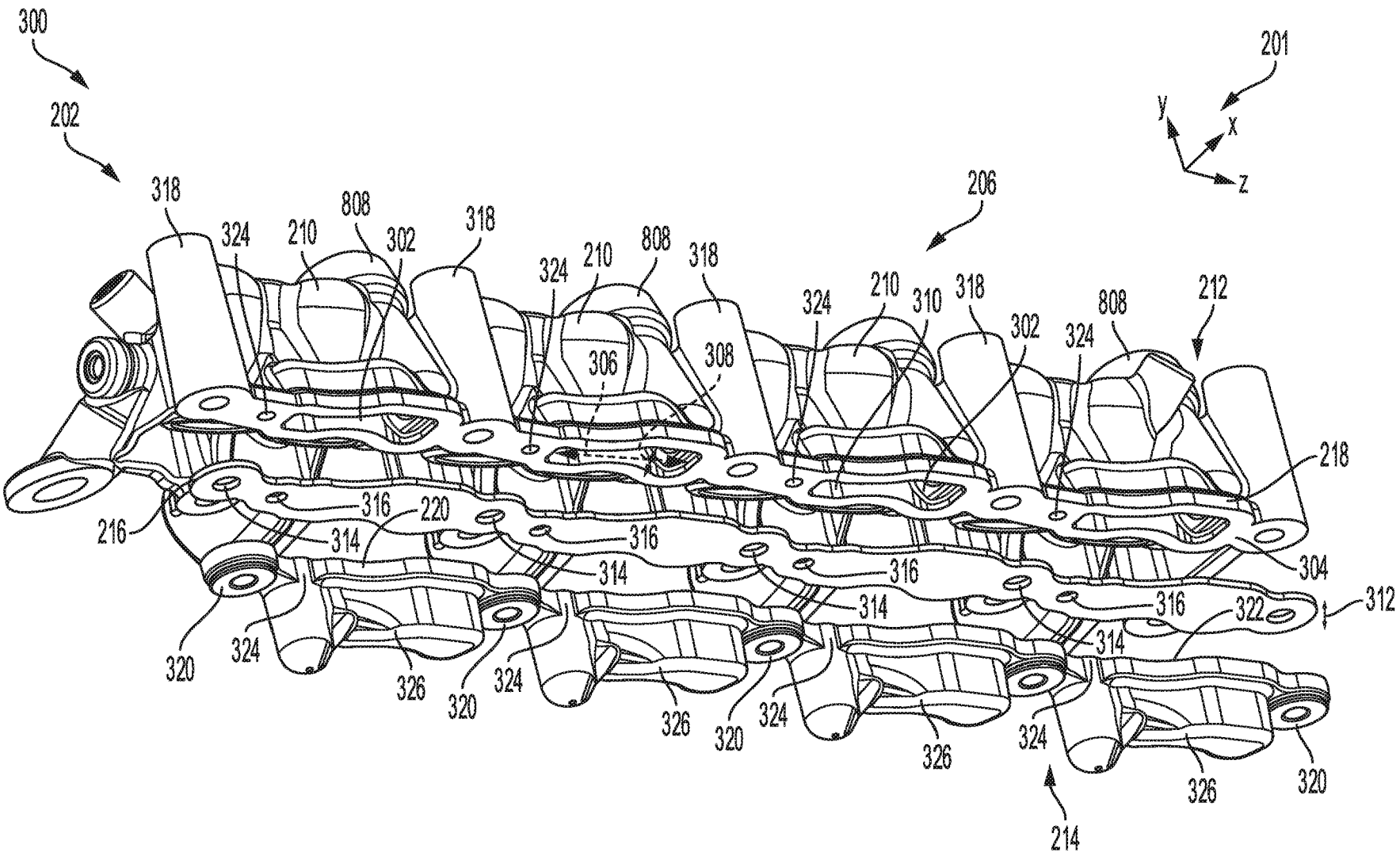
FIG. 3 shows an exploded view of the VVA assembly of FIG. 2.
Figure 4:
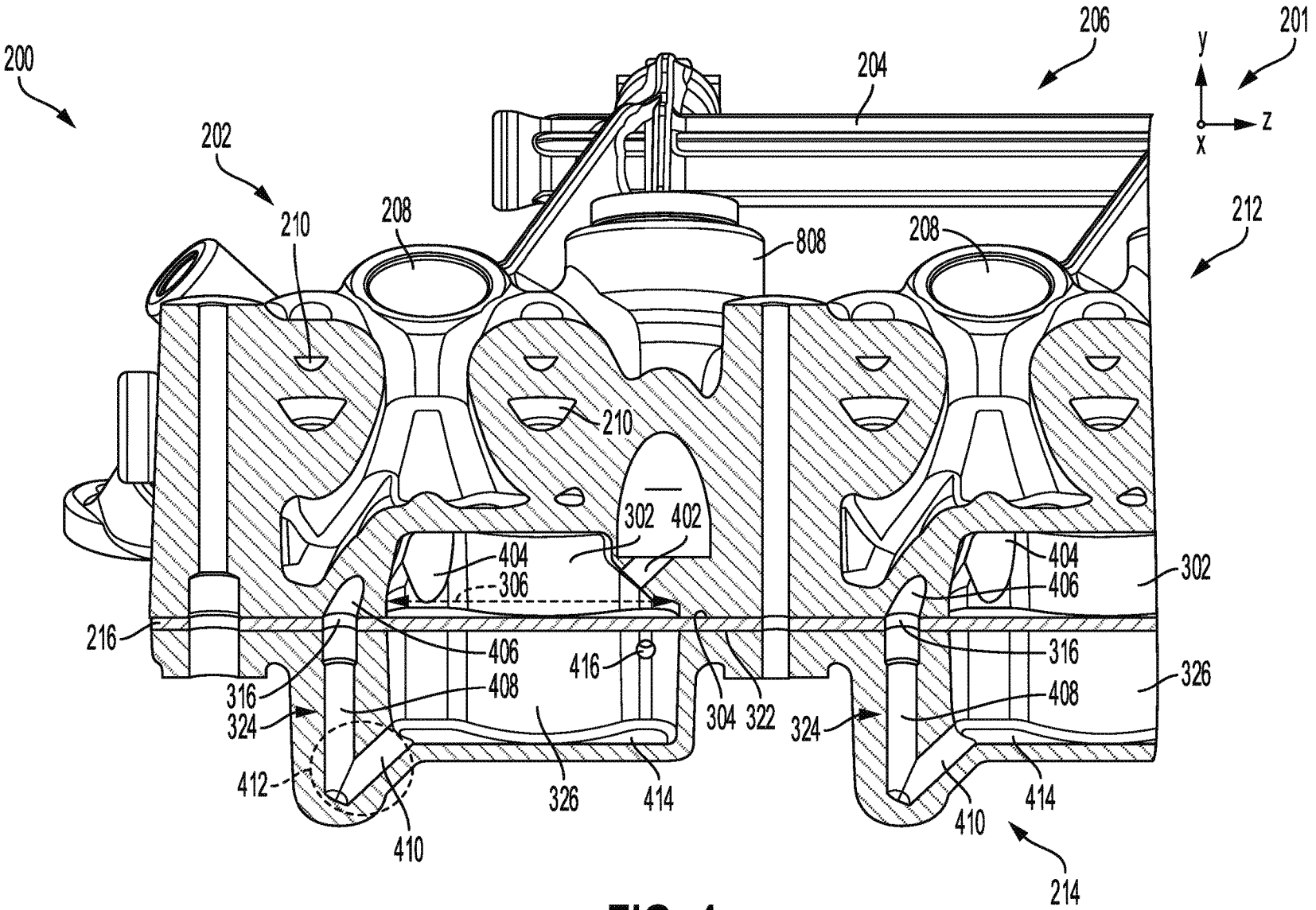
FIG. 4 shows a first cross-section of the VVA assembly, taken along a longitudinal axis of the assembly.
Figure 5:
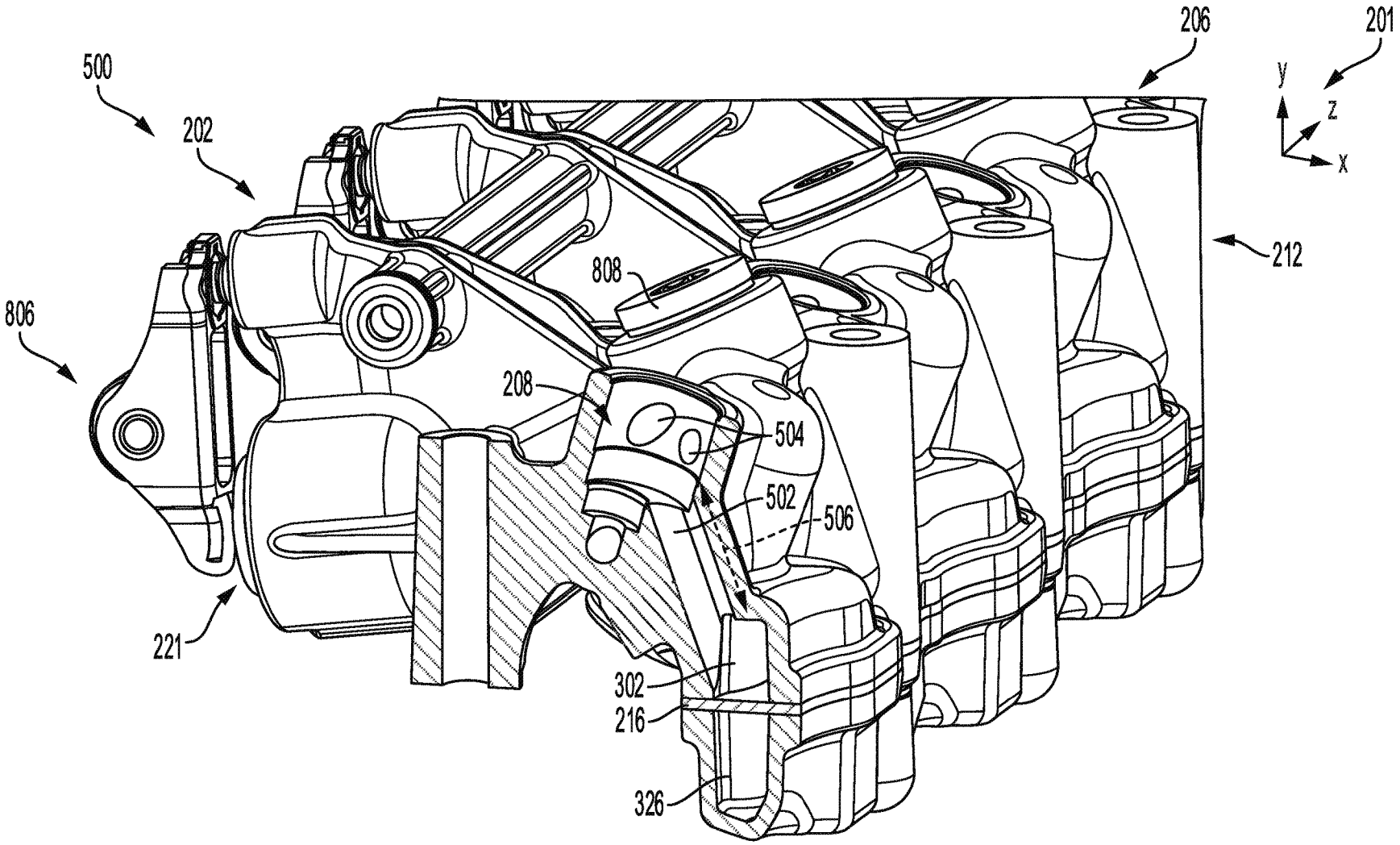
FIG. 5 shows a perspective view of a second cross-section of the VVA assembly, taken along an axis perpendicular to the first cross-section of FIG. 4, and depicting pressure reservoirs of the assembly with an actuating valve omitted.
Figure 6:
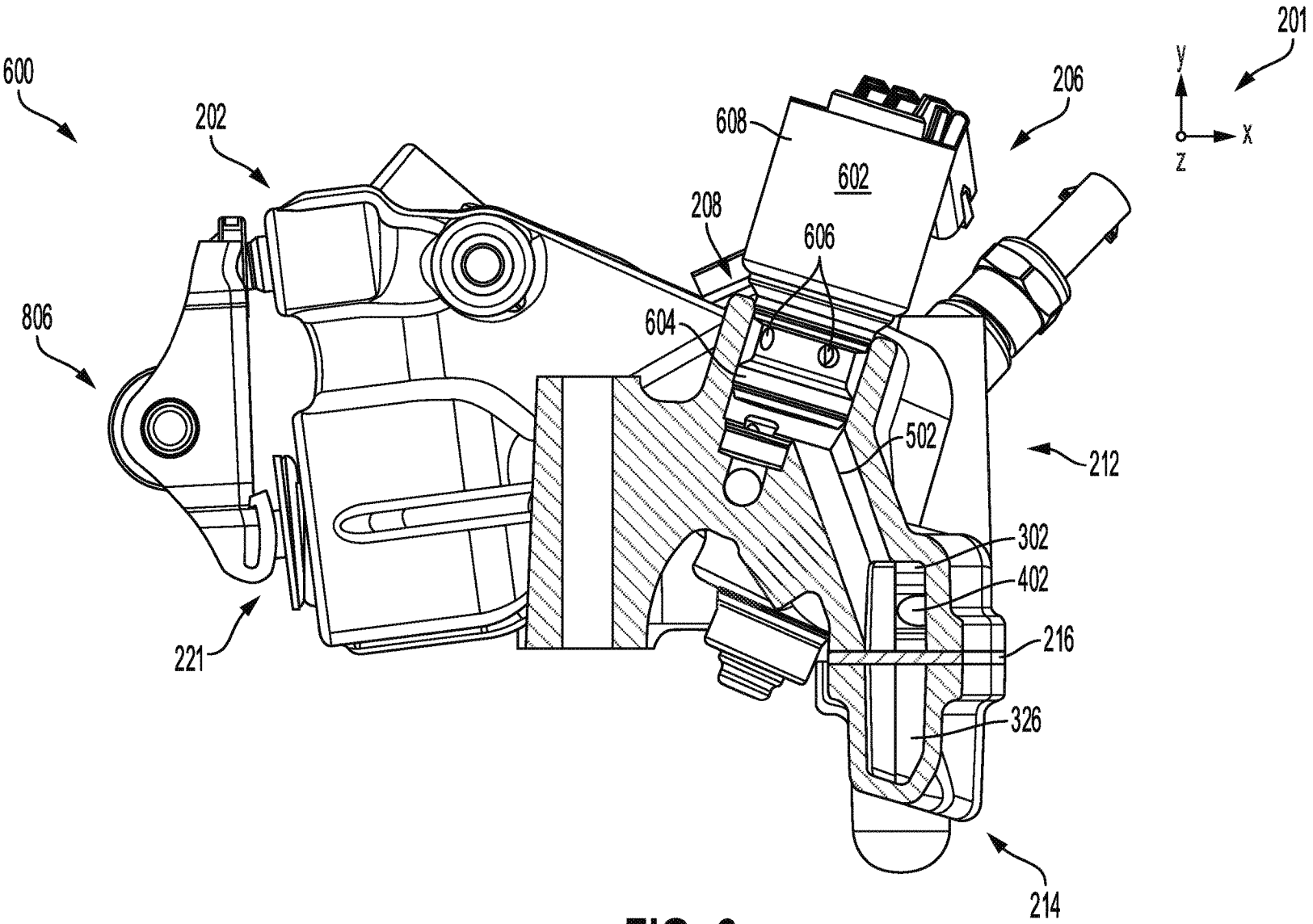
FIG. 6 shows the cross-section of FIG. 5 with the actuating valve included.
Figure 7:
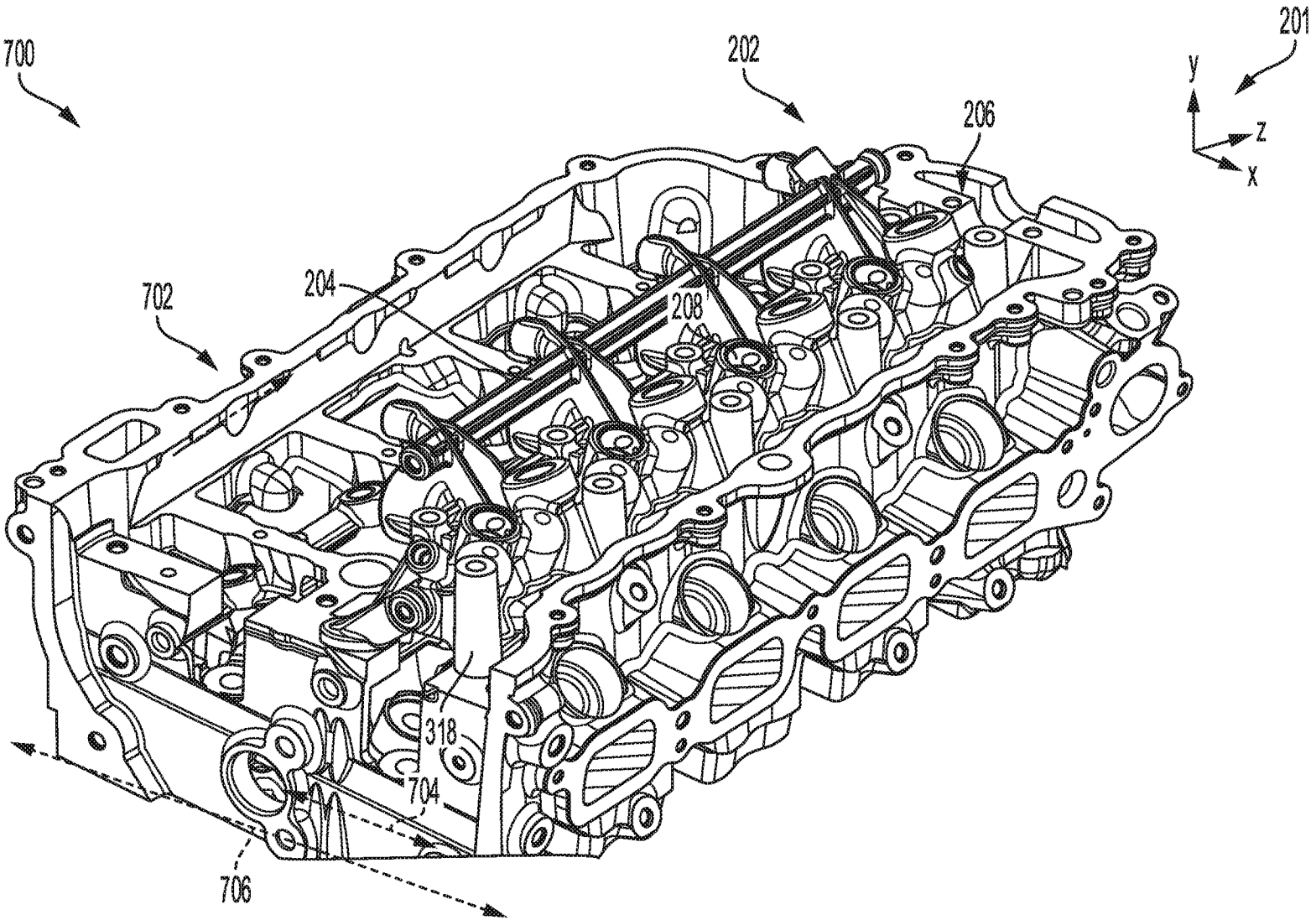
FIG. 7 shows the VVA assembly coupled to an engine cylinder head.

The variable valve actuation system may be included in an engine system to continually adjust valve timing and lift of cylinder valves based on engine operation, providing enhanced power output when increased torque is demanded and boosting fuel efficiency during low engine speeds and loads when fuel economy may be prioritized over performance. An example of an engine system, which may be an internal combustion engine or a hybrid-electric engine, is shown in a schematic diagram in FIG. 1. A variable valve actuation (VVA) assembly may be coupled to a cylinder head of the engine system, utilizing hydraulic pressure to control valve lift and timing of cylinder valves. The VVA assembly is shown in from a first perspective view in FIG. 2, a second perspective view in FIG. 8, and an exploded view in FIG. 3, the exploded view depicting a vertical stacking of pressure reservoirs in the VVA assembly. Cross-sections of the VVA assembly are illustrated in FIGS. 4-6, showing positioning of a higher pressure reservoir and a lower pressure reservoir relative to one another and to valve actuators as well as positioning of a hydraulic medium retention feed within the VVA assembly. The VVA assembly is shown nested in a cylinder head in FIG. 7, depicting a footprint of the VVA assembly with respect to the cylinder head.

FIGS. 2-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
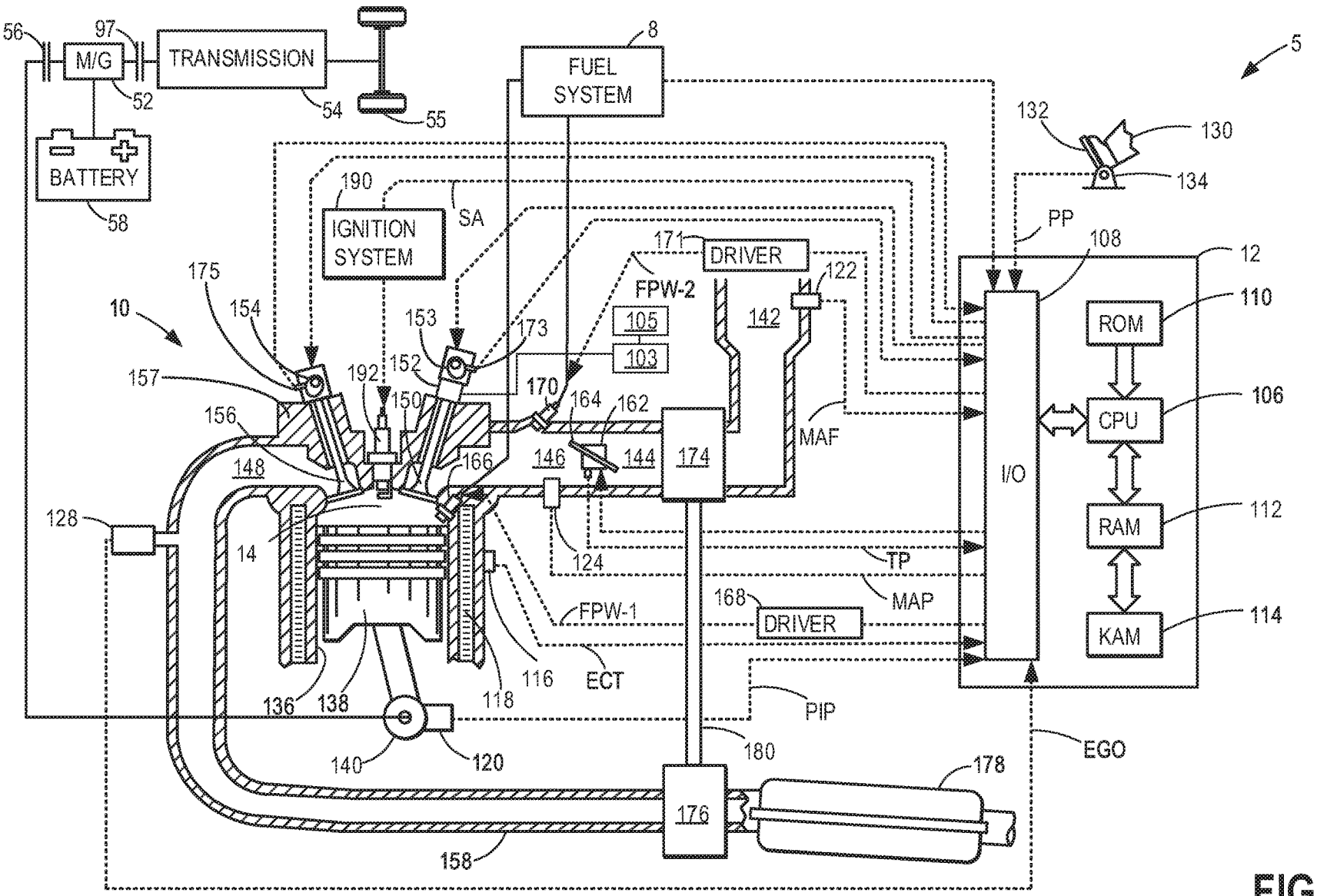
FIG. 1 shows an example of an engine system in which a variable valve actuation (VVA) assembly may be implemented.

Turning now to FIG. 1, an example of a combustion chamber or cylinder of internal combustion engine 10 is depicted. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. The cylinder 14 is capped by cylinder head 157. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 includes one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In the example of FIG. 1, intake valve 150 and exhaust valve 156 are actuated (e.g., opened and closed) via respective cam actuation systems 153 and 154. Cam actuation systems 153 and 154 each include one or more cams mounted on one or more camshafts and may utilize one or more of cam profile switching (CPS), variable cam timing (VCT), variable valve timing (VVT) and/or variable valve lift (VVL) systems that may be operated by controller 12 to vary valve operation. In one example, as illustrated in FIGS. 2-7, actuation of variable valve timing and variable valve lift may be enabled by an electro-hydraulic valve train 152 that leverages pressure provided by a hydraulic medium to continuously regulate lifting of the intake valve 150. The electro-hydraulic valve train 152 may be positioned between the cam and the intake valve 150 and operate either synchronized with or independently of the cam. The electro-hydraulic valve train 152 may include a higher pressure circuit 103 and a lower pressure circuit 105, shown in FIG. 1 coupled to cam actuation system 153 and used to control hydraulic pressure in the electro-hydraulic valve train 152. Details of the electro-hydraulic valve train 152 and hydraulic pressure circuits are described further below with reference to FIGS. 2-7.

The angular position of intake and exhaust camshafts may be determined by position sensors 173 and 175, respectively. In alternate embodiments, one or more additional intake valves and/or exhaust valves of cylinder 14 may be controlled via electric valve actuation. For example, cylinder 14 may include one or more additional intake valves controlled via electric valve actuation and one or more additional exhaust valves controlled via electric valve actuation.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 housed within cylinder head 157 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8 which may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics, such as differences in size. For example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 97 is provided between electric machine 52 and transmission 54. Controller 12 may send a signal to an actuator of each clutch (e.g., first clutch 56 and/or second clutch 97) to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

As described above, FIG. 1 shows only one cylinder of multi-cylinder engine 10. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

The controller 12 receives signals from the various sensors of FIG. 1 and employs the various actuators of FIG. 1 to adjust engine operation based on the received signals and instructions stored on a memory of the controller. For example, adjusting a duration of time that an intake valve 150 is maintained in a lifted position, allowing intake air to flow into the cylinder 14, may include adjusting hydraulic pressures in actuators of the electro-hydraulic valve train 152 coupled to the intake valve 150 based on data received from the pedal position sensor 134 of the input device 132. Depression of the input device 132, when configured as an accelerator pedal, may indicate a demand for boost and valve lift and lift timing may be adjusted accordingly.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

As described above, both VVL and VVT may be enabled by an electro-hydraulic valve train that includes two or more hydraulic chambers, or reservoirs, maintained at different levels of pressure. Changes in hydraulic pressure in the electro-hydraulic valve train may actuate opening and closing of cylinder poppet valves (e.g., intake valves). The changes in hydraulic pressure are regulated by fluidly coupling or decoupling the hydraulic chambers to the poppet valves using an electrically-activated solenoid valve.

The hydraulic chambers may include a higher pressure reservoir, which may be included in the higher pressure circuit 103 of FIG. 1, and a lower pressure reservoir, which may be included in the lower pressure circuit 105 of FIG. 1. To maintain a positioning of the higher pressure reservoir proximate to the poppet valves in conventional configurations, a cavity of the higher pressure reservoir may be partially disposed in a housing for the electro-hydraulic train and partially disposed in a cylinder head of the engine, positioning the higher pressure reservoir adjacent to the poppet valves along a horizontal plane. The lower pressure reservoir may form a cavity in a base plate of the housing, adjacent to the higher pressure reservoir along the horizontal plane.

As a result of a relative positioning of the higher pressure and lower pressure reservoirs in the electro-hydraulic valve train housing, the housing may have an undesirably wide footprint, occupying a volume within the front end compartment of a vehicle that may be challenging to accommodate. The placement of the reservoirs may also pose difficulty towards adapting a geometry of the cylinder head to couple to the housing so that a hydraulic medium and hydraulic pressure provided by the medium are sealed within the housing and cylinder head with a low likelihood of leakage. In addition, partial inclusion of the cavity of the higher pressure reservoir in the cylinder head increases a complexity of the cylinder head geometry, complicating manufacture of the cylinder head and escalating costs.

The footprint of the electro-hydraulic valve train housing may be decreased by adapting the cylinder head with a variable valve actuation (VVA) stacked assembly. The VVA stacked assembly may be a unit that positions a higher pressure reservoir and a lower pressure reservoir in a vertical arrangement, along a vertical plane of the VVA stacked assembly. Both the higher pressure reservoir and the lower pressure reservoir may be entirely integrated into a housing of the VVA stacked assembly and separated from one another by a metering plate (also referred to as a diverter or gasket). A horizontal footprint of the VVA stacked assembly may be reduced compared to an electro-hydraulic valve train housing with horizontally aligned pressure reservoirs while maintaining the higher pressure reservoir at a similar distance from the poppet valves. An example embodiment of a VVA stacked assembly 202 is shown in a first, perspective view 200 in FIG. 2.

Figure 2:
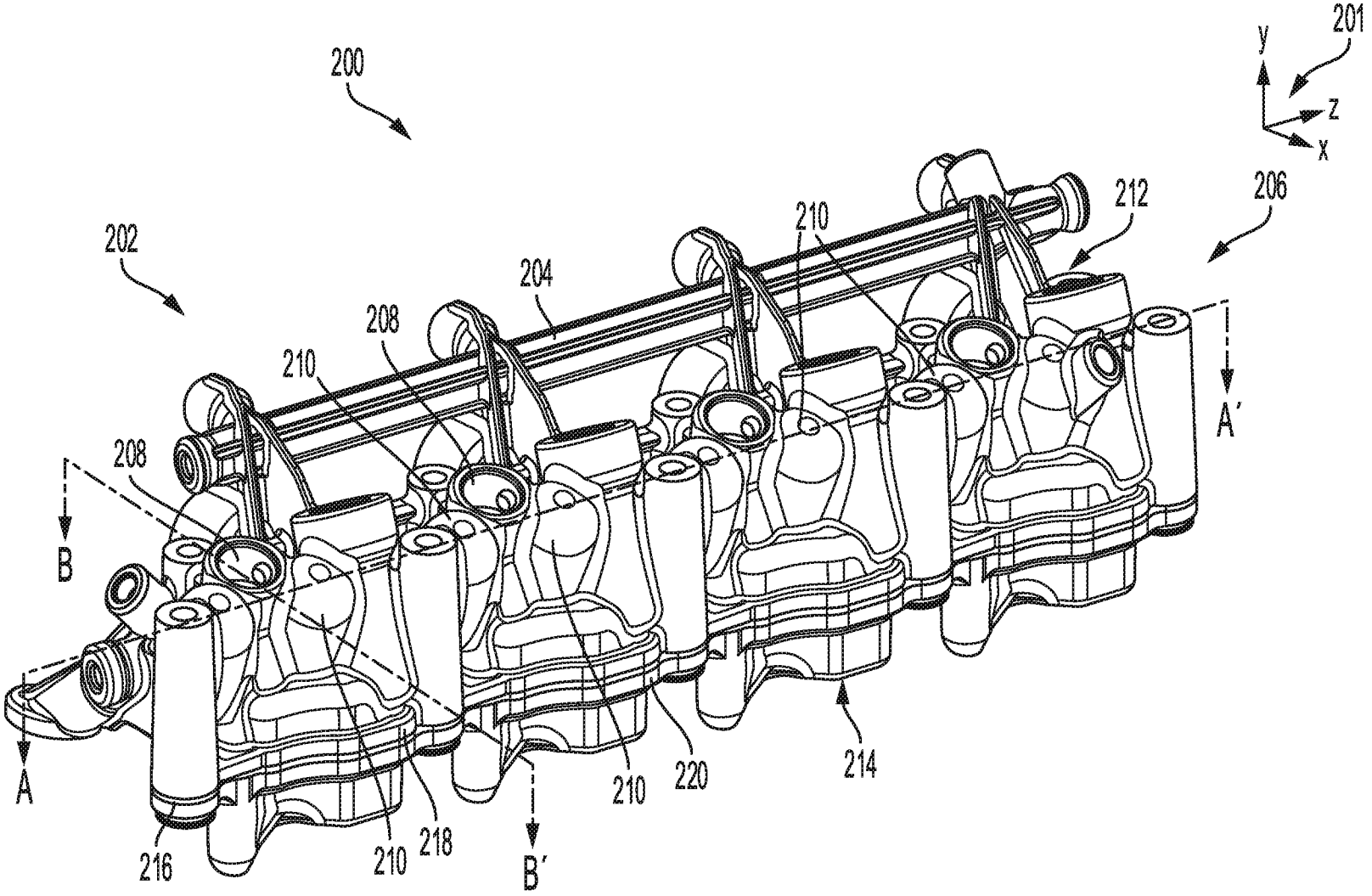
FIG. 2 shows an example of a VVA assembly from a first perspective view.

The VVA stacked assembly 202 shown in FIG. 2 may, in one example, be used in the electro-hydraulic valve train 152 of FIG. 1. A set of reference axes 201 are provided, indicating a y-axis, an x-axis, and a z-axis. In some examples, the y-axis is parallel with a vertical direction and with gravity 199 and perpendicular to a ground surface on which a vehicle, the vehicle including the VVA stacked assembly 202, may traverse. In addition, the y-axis and vertical direction may be parallel to a line normal to fluid faces of fluids stored in pressure reservoirs, or cavities, described further below. As such, any reference to stacking indicates arrangement of one object over another along the vertical direction (e.g., the y-axis), normal to the ground surface.

Figure 8:
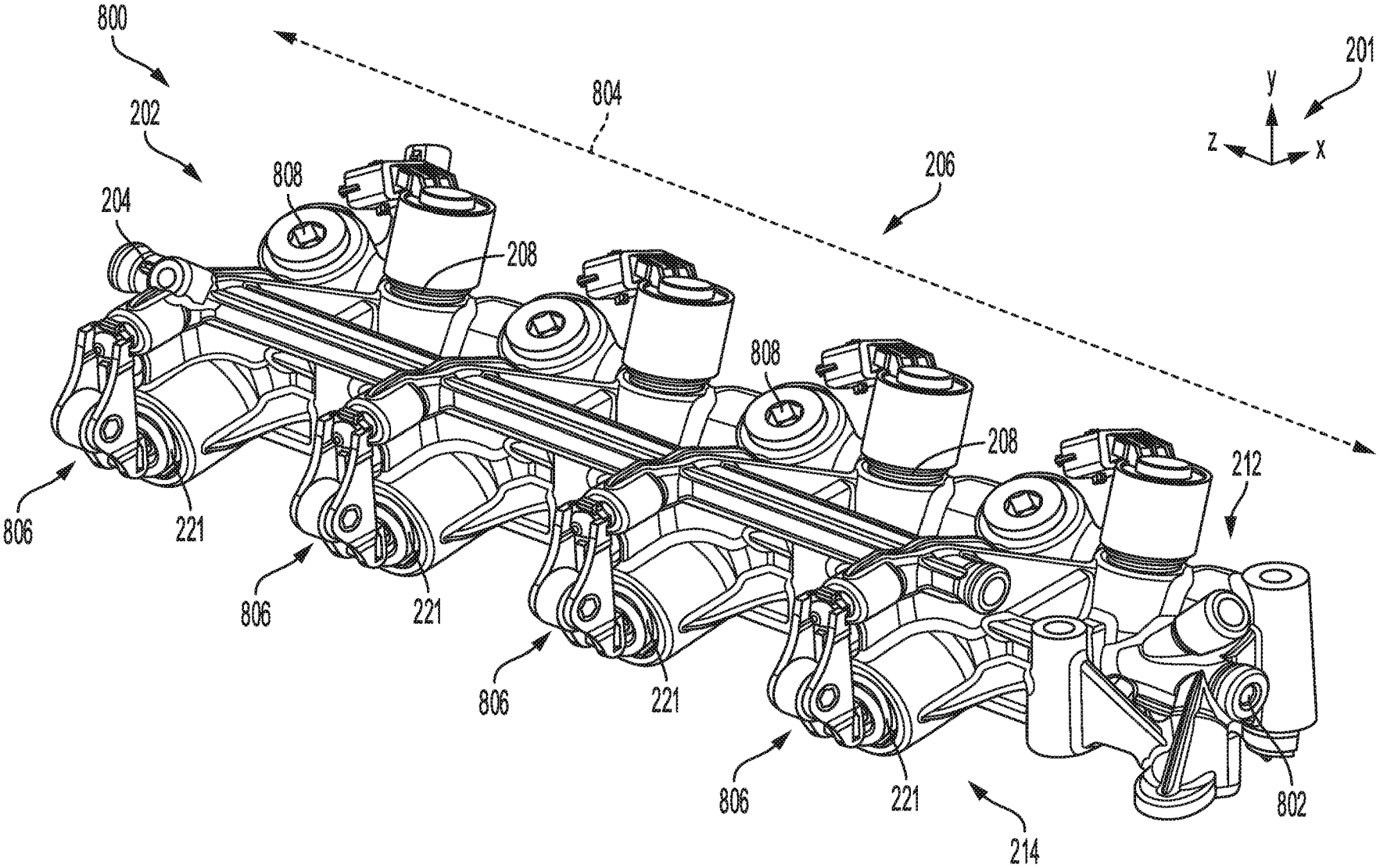
FIG. 8 shows the VVA assembly from a second perspective view.

A low pressure oil gallery 204 is depicted above, with respect to the y-axis, and coupled to a housing 206 of the VVA stacked assembly 202. The housing 206 of the VVA stacked assembly 202 may have a rigid structure formed from a heat-tolerant, durable material such as aluminum, steel or cast iron. The housing 206 may be shaped with various ports, chambers and walls of varying geometries to accommodate coupling of various components to the housing 206 or through the housing 206 to cylinders of an engine block. For example, the housing 206 may include solenoid valve ports 208 to accommodate insertion of solenoid valves supplied by high pressure oil pumps 221 (as shown in FIGS. 5-6 and 8), the solenoid valves moderating flow of a hydraulic medium between high pressure reservoirs and low pressure reservoirs of the VVA stacked assembly 202. The housing 206 may also include intake valve actuator ports 210 to accommodate insertion of devices to actuate lifting and closing of intake valves. Each intake valve may be associated with at least one of the solenoid valve ports 208 and at least two of the intake valve actuator ports 210, as shown in FIGS. 2-4. However, in other examples of the VVA stacked assembly 202, variations in numbers of each type of port relative to each intake valve are possible.

The housing 206 may have an upper portion 212 and a lower portion 214 with a metering plate 216 arranged in between. The metering plate 216 may be similar to a gasket, made of a more deformable material than the housing 206 to provide a sealing engagement between the metering plate 216 and a base 218 of the upper portion 212 and between the metering plate 216 and an upper edge 220 of the lower portion 214 of the housing 206. The material of the metering plate 216 may be fluidly impenetrable. In other words, the metering plate 216 acts as a barrier between cavities above the metering plate 216 and cavities below the metering plate 216 so that the cavities are not fluidly coupled.

The upper portion 212 may comprise a larger portion of the housing 206 than the lower portion 214. For example, 80% of a total mass of the housing 206 may be attributed to the upper portion 212 while 20% of the total mass may be due to the lower portion 214. In another example, 70-80% of a total mass of the housing 206 may be attributed to the upper portion 212 while a remaining, 30-20% of the total mass may be attributed to the lower portion 214. The base 218 of the upper portion 212 may be similarly shaped as the upper edge 220 of the lower portion 214, e.g., a perimeter of the base 218 of the upper portion 212 may match a perimeter of the upper edge 220 of the lower portion 214, as well as an outer geometry of the metering plate 216, as shown in FIG. 3.

An alternate, second perspective view 800 of the VVA stacked assembly 202 is shown in FIG. 8. The second perspective view 800 shows a positioning of a high pressure oil gallery 802 below the low pressure oil gallery 204, with respect to the y-axis, and integrated into the upper portion 212 of the housing 206 of the VVA stacked assembly 202. The high pressure oil gallery 802 may extend across a length 804 of the VVA stacked assembly 202 and provide high pressure oil to cavities of the upper portion 212. The VVA stacked assembly 202 may also include a plurality of oil pump assemblies 806, each assembly of the oil pump assemblies 806 connected to one of the high pressure oil pumps 221 and fluidly coupled to one of the solenoid valve ports 208, and a plurality of oil pressure recovery ports 808. The plurality of oil pressure recovery ports 808 may be reservoirs coupled to the high pressure oil gallery 802 and maintained at a high hydraulic pressure by the high pressure oil gallery 802.

Details of an inner geometry of the VVA assembly 202 are depicted in an exploded view 300 of the VVA stacked assembly 202 in FIG. 3 with the upper portion 212 separated from the lower portion 214 and the metering plate 216 arranged in between. Components previously introduced may be similarly numbered in this figure and subsequent figures. The upper portion 212 has a plurality of upper cavities 302, recessed into a bottom surface 304 of the upper portion 212. Each of the plurality of upper cavities 302 may have a length 306 greater than a width 308 of each upper cavity, the width 308 varying along the length 306. Each of the plurality of upper cavities 302 may have an irregular geometry formed from curved inner walls 310, each upper cavity forming a chamber within the upper portion 212 of the housing 206. The plurality of upper cavities 302 may be higher pressure reservoirs configured to be filled with a hydraulic medium, such as oil. The plurality of upper cavities 302 may be fluidly coupled to a pressure source, such as piston pumps, via channels in the upper portion 212 of the housing 206.

The metering plate 216 has a thickness 312 that is thinner than a thickness of the housing 206. The metering plate 216 provides a solid barrier below each of the plurality of upper cavities 302, forming bottom surfaces for each of the plurality of upper cavities 302. In this way, the metering plate 216 encloses the plurality of upper cavities 302 so that the hydraulic medium does not exit the upper cavities via the bottom surface 304. Circular apertures extend entirely through the thickness 312 of the metering plate 216, including a larger, first set of apertures 314 and a smaller, second set of apertures 316. The first set of apertures 314 may align with a first set of bosses 318 disposed in the upper portion 212 of the housing 206 and a second set of bosses 320 disposed in the lower portion 214 of the housing 206. Bolts may be inserted into the first set of bosses 318 in the upper portion 212, threaded through the first set of apertures 314 in the metering plate 216 and through the second set of bosses 320 and into threaded apertures in a cylinder head to couple the housing 206 to the cylinder head and provide compression between the upper portion 212 and the lower portion 214 to sealingly engage the metering plate 216 with the bottom surface 304 of the upper portion 212 and an upper surface 322 of the lower portion 214 of the housing 206. The first set of apertures 314 may be spaced apart from one another along the z-axis by at least the length 306 of each of the plurality of upper cavities 302. The first set of apertures 314 and the second set of apertures 316 may be arranged in an alternating pattern along the z-axis so that an aperture of the second set of apertures 316 is arranged between adjacent apertures of the first set of apertures 314.

The second set of apertures 316 may be communication orifices 316 aligned with retention feeds 324 extending from the upper portion 212 to the lower portion 214 of the housing 206, along the y-axis. As such, the retention feeds 324 may have a circular cross-section, e.g., a cross-section of the retention feeds 324 taken along the x-z plane. The communication orifices 316 allow fluid in a portion of the retention feeds 324 in the upper portion 212 of the housing 206 to exchange with fluid in a portion of the retention feeds 324 in the lower portion 214 of the housing 206. The retention feeds 324 may be fluidly coupled to the plurality of upper cavities 302 and directly coupled to a plurality of lower cavities 326 in the lower portion 214 of the housing 206.

The plurality of lower cavities 326 may form chambers within the lower portion 214 of the housing 206 that are positioned directly below the plurality of upper cavities 302, with respect to the y-axis. Separation of the plurality of lower cavities 326 from the plurality of upper cavities 302 by the metering plate 216 allows the plurality of lower cavities 326 to hold a different level of pressure than the plurality of upper cavities 302. The metering plate 216 may form upper surfaces of the plurality of lower cavities 326. As such, the plurality of lower cavities 326 may be low pressure retention reservoirs, maintaining the hydraulic medium at a lower pressure than the plurality of upper cavities 302. A length, defined along the z-axis, of the plurality of lower cavities 326 may be greater than a width, defined along the x-axis, of the plurality of lower cavities 326 and each lower cavity may have an irregular geometry formed by curved inner walls. The plurality of lower cavities 326 may be viewed in greater detail in a first cross-section 400 shown in FIG. 4.

The first cross-section 400 is taken along line A-A' shown in FIG. 2, along the y-z plane. In FIG. 4, a vertical stacking, with respect to the y-axis, of the plurality of upper cavities 302 directly over the plurality of lower cavities 326 is depicted. The length 306 of the plurality of upper cavities 302 is longest at a lower region of the plurality of upper cavities 302, e.g., immediately adjacent to the metering plate 216, and is similar to the length of the plurality of lower cavities 326. The plurality of upper cavities 302 may be fluidly coupled to the plurality of oil pressure recovery ports 808 through a first channel 402 and fluidly coupled to the solenoid valve ports 208 through a second channel 404. The plurality of upper cavities 302 may also be coupled to a first portion 406 of the retention feeds 324 arranged in the upper portion 212 of the housing and fluidly coupled to the intake valve actuators ports 210.

The first portion 406 of the retention feeds 324 is disposed in the upper portion 212 of the housing 206 and may extend into the upper portion 212 from the bottom surface 304 of the upper portion 212 at an angle with respect to the y-axis. A second portion 408 of the retention feeds 324 extends downwards, parallel with the y-axis, into the lower portion 214 of the housing 206 from the upper surface 322 of the lower portion 214. The second portion 408 of the retention feeds 324 is coupled to a third portion 410 of the retention feeds, the third portion 410 extending between the second portion 408 and the plurality of lower cavities 326 at an angle with respect to both the y-axis and the z-axis. A section of each of the retention feeds 324 that includes both the second potion 408 and the third portion 410, indicated by dashed circle 412, is positioned lower than a bottom surface 414 of the plurality of lower cavities 326.

The plurality of lower cavities 326 also include a return to sump port 416 that fluidly couples an oil sump to the plurality of lower cavities 326. Thus, when the VVA stacked assembly 202 is operating, timing and lift height of engine intake valve lift may be varied by adjusting hydraulic pressure in the VVA stacked assembly 202. For example, during regulation of valve lift by cams of the low pressure oil gallery 204, an electrically actuated solenoid valve in each of the solenoid valve ports 208 may be closed. The hydraulic medium, e.g., oil, in the plurality of upper cavities 302 may act as hydraulically rigid pushrods in place of conventional pushrods or tappets of the intake valves.

To provide early intake valve closing (EIVC), the solenoid valve in each of the solenoid valve ports 208 may be opened, disconnecting the low pressure oil gallery 204 from the intake valves in each of the intake valve actuator ports 210. A metered volume of the oil is pushed out of the plurality of upper cavities 302 by intake valve springs drawing the intake valves closed, decreasing the hydraulic pressure at the intake valves. The oil flows through the retention feeds 324 and into the plurality of lower cavities 326.

As another example, to enable late intake valve opening (LIVO), the solenoid valve may be maintained open and the cam may force oil into the pressure accumulator, coupled to the plurality of lower cavities 326 by the return to sump port 416, via piston pumps arranged in the solenoid valve ports 208. In yet another example, EIVC and LIVO may be combined to provide multi-lift. During multi-lift, the pressure accumulators may feed oil retained in the plurality of lower cavities 326 to the plurality of upper cavities 302 when the solenoid valves are open, thereby increasing hydraulic pressure at the intake valves.

It will be appreciated that the housing 206 shown in FIGS. 2-8 of the VVA stacked assembly 202 is a non-limiting example of a housing for such a system. Other examples of the VVA stacked assembly 202 may include variations in relative dimensions and geometries of the various elements include in the housing 206. For example, relative volumes, shapes, and sizes of the plurality of lower cavities 326 with respect to the plurality of upper cavities 302 may differ from the views shown. Other embodiments may include upper cavities with larger volumes than the lower cavities, or upper cavities that are taller than the lower cavities, or non-matching perimeters of the upper cavities and lower cavities, etc. Furthermore, variations in relative positioning of intake valve ports and solenoid valve ports to the upper and lower cavities as well as quantities of cavities, chambers, and ports are possible without departing from the scope of the present disclosure.

Inner channels of the VVA stacked assembly 202 are shown in further detail in a second cross-section 500 of FIG. 5. The second cross-section 500 is taken along line B-B' shown in FIG. 2 and slices through one of the solenoid valve ports 208 as well as through a hydraulic bridge 502 extending between an upper cavity of the plurality of upper cavities 302 and the solenoid valve port. The hydraulic bridge 502 may have a circular cross section, e.g., along a plane perpendicular to a length 506 of the hydraulic bridge 502. The hydraulic bridge 502 is coupled to the solenoid valve port via orifices 504 that allow hydraulic pressure in the plurality of upper cavities 302 to be communicated to the intake valve actuator ports 210.

A similar cross-section is shown in a third cross-section 600 in FIG. 6. The third cross-section 600 is also taken along the line B-B' in FIG. 2 but showing a different angle of view than the second cross-section 500 of FIG. 5. In addition, the third cross-section 600 of FIG. 6 includes additional components of the VVA stacked assembly 202 that are not integrated into the housing 206. For example, a solenoid valve 602 is shown positioned in one of the solenoid valve ports 208. The solenoid valve 602 may have a lower section 604 that is inserted into the intake valve port, sealing oil within the solenoid valve port. The lower section 604 has a plurality of openings 606 to allow oil to flow between the solenoid valve port and an inner chamber of the solenoid valve 602. The solenoid valve 602 also has an upper section 608 protruding from the solenoid valve port. Both the upper section 608 and the lower section 604 of the solenoid valve 602 may be generally cylindrical. The upper section 608 may enclose a piston, configured to move within the upper section 608 of the solenoid valve 602 to control fluid communication between high pressure circuits originating from the high pressure oil pumps 221 to actuate the intake valve motion.

A VVA stacked assembly may be directly coupled to a cylinder head to control actuation of engine intake valves at each cylinder. The VVA stacked assembly 202 of FIGS. 2-6, and 8 is shown in a perspective view 700 in FIG. 7 nested in a cylinder head 702. The cylinder head 702 depicted in FIG. 7 is configured for an inline 4-cylinder (I4) engine. In other examples, however, the VVA stacked assembly 202 and the cylinder head 702 may be adapted to other types of engines, such as V6, V8, 13, etc. The cylinder head 702 may be positioned over an engine block, sealing the cylinders when coupled to the engine block. The VVA stacked assembly 202 may be secured to the cylinder head 702 by bolts inserted through the first set of bosses 318 and the second set of bosses 320 in the housing 206, as described above with reference to FIG. 3. A first camshaft (not shown) may be coupled to the housing 206 of the VVA stacked assembly 202 to actuate the intake valves when the VVA stacked assembly is not engaged with the intake valves, and a second camshaft (not shown) may be coupled to exhaust valves in the cylinder head, both the first and second camshafts arranged adjacent to and parallel with the low pressure oil gallery 204.

Engine valves, e.g., engine cylinder valves such as intake and exhaust valves, may be disposed in the cylinder head below the low pressure oil gallery 204. The VVA stacked assembly 202 may be positioned over the intake valves so that the intake valve actuator ports 210 are aligned directly over the intake valves. As such, higher pressure reservoirs, e.g., the plurality of upper cavities 302 of FIGS. 2-6, may be oriented near to and below, with respect to the y-axis, the intake valves. The intake valves may also be positioned substantially below the solenoid valve ports 208 and the intake valve actuator ports 210. The VVA stacked assembly 202 may allow the intake valves of an engine system to be actuated in unison or individually, with lift and lift timing independently adjusted at each cylinder, according to engine operating conditions.

A width 704 of the VVA stacked assembly 202, defined along the x-axis, may be much narrower than a width 706 of the cylinder head 702 due to the vertical stacking of the higher pressure reservoirs and lower pressure reservoirs, e.g., the plurality of upper cavities 302 and the plurality of lower cavities, respectively, shown in FIGS. 2-6. For example, the width 704 may 25%, 30%, 40%, or between 10-40% of the width 706 of the cylinder head 702. In examples of conventional configurations, the lower pressure reservoirs may be positioned adjacent to the higher pressure reservoirs along a horizontal plane and the higher pressure reservoirs may be arranged adjacent to intake valve actuators, e.g., intake valve actuators arranged in the intake valve actuator ports 210 of FIGS. 2-4, also along a horizontal plane. In such arrangements, a width of an electro-hydraulic valve train, similarly used as the VVA stacked assembly 202, may be widened and result in a larger footprint of the electro-hydraulic valve train. Space availability for the camshaft and other components actuating exhaust valve lift may be reduced. In contrast, the vertical stacking of the higher and lower pressure reservoirs shown in FIGS. 2-8 allows the width of the VVA stacked assembly 202 to be defined by the ports and chambers accommodating the intake valve actuators rather than the pressure reservoirs. In addition, both the higher pressure reservoirs and the lower pressure reservoirs may be entirely incorporated into the housing 206 of the VVA stacked assembly 202, thereby precluding casting of cavities into the cylinder to accommodate positioning of the higher pressure reservoirs, as seen in examples of horizontally aligned pressure reservoirs.

In this way, an electro-hydraulic valve train may provide variable valve actuation at engine intake valves with a decreased footprint in a vehicle's front end compartment. The electro-hydraulic valve train may have a variable valve actuation (VVA) stacked assembly with vertically stacked higher pressure reservoirs arranged vertically over lower pressure reservoirs. The higher and lower pressure reservoirs may be further stacked below actuators of the VVA stacked assembly such as solenoid valves, pressure accumulators and piston pumps and positioned lower, relative to a vertical axis, than engine intake valves. By aligning the pressure reservoirs vertically, a footprint of the VVA stacked assembly is reduced, additional complexity is not imposed on cylinder head casting, and a proximity of the higher pressure reservoir to the intake valves is maintained to enable efficient communication of hydraulic pressure between the higher pressure reservoir and the intake valve actuators.

The technical effect of adapting an engine system with the VVA stacked assembly is that a variable lift and timing are enabled, allowing increased fuel economy and performance of the engine system, while a footprint of the VVA stacked assembly is reduced.

In one example, a variable valve actuation (VVA) assembly includes a plurality of actuators to adjust a lift height and duration of engine valves, a first fluid chamber, having a first pressure, arranged vertically below the engine valves and the plurality of actuators and fluidly coupled to the plurality of actuators, and a second fluid chamber, having a second pressure, positioned directly below the first chamber and coupled to the first fluid chamber by a channel. In a first example of the VVA assembly, the first pressure in the first fluid chamber is higher than the second pressure in the second fluid chamber. A second example of the VVA assembly optionally includes the first example, and further includes a metering plate arranged between the first fluid chamber and the second fluid chamber and separating an inner volume of the first fluid chamber from an inner volume of the second fluid chamber. A third example of the VVA assembly optionally includes one or more of the first and second examples, and further includes wherein the metering plate is sandwiched between an upper portion of a housing of the VVA assembly that includes the first fluid chamber, and a lower portion of the housing that includes the second fluid chamber. A fourth example of the VVA assembly optionally includes one or more of the first through third examples, and further includes, wherein the metering plate is fluidly impenetrable and seals the inner volume of the first fluid chamber from the inner volume of the second fluid chamber and wherein the metering plate includes an aperture aligned with the channel coupling the second fluid chamber to the first fluid chamber to allow fluid to flow continuously through the channel. A fifth example of the VVA assembly optionally includes one or more of the first through fourth examples, and further includes, wherein the first fluid chamber and the second fluid chamber are cavities in the housing of the VVA assembly and the housing is configured to couple to a cylinder head. A sixth example of the VVA assembly optionally includes one or more of the first through fifth examples, and further includes, wherein a width of the housing of the VVA assembly, the width perpendicular to a vertical axis of the VVA assembly, is defined by a width of the plurality of actuators arranged above the first fluid chamber. A seventh example of the VVA assembly optionally includes one or more of the first through sixth examples, and further includes, wherein the channel extends in a vertical direction from the first fluid chamber to the second fluid chamber and has at least one portion that extends vertically lower than a bottom surface of the second fluid chamber. An eighth example of the VVA assembly optionally includes one or more of the first through seventh examples, and further includes wherein a housing of the VVA assembly includes an integrated low pressure oil gallery and an integrated high pressure oil gallery.

In another example, a cylinder head includes a variable valve actuation assembly having vertically stacked pressure reservoirs, including a first pressure reservoir with a first pressure and a second pressure reservoir with a second pressure, storing a pressure-generating medium and valve actuators fluidly coupled to the vertically stacked pressure reservoirs, and engine valves positioned vertically above, relative to a direction of gravity, the pressure reservoirs and configured to lift based on pressure communicated to the engine valves from the valve actuators. In a first example of the cylinder head, the first pressure reservoir is a higher pressure reservoir stacked above the second pressure reservoir, the second pressure reservoir being a lower pressure reservoir and wherein the higher pressure reservoir is separated from the lower pressure reservoir by a metering plate. A second example of the cylinder head optionally includes the first example, and further includes, wherein the valve actuators include a solenoid valve and wherein actuation of the solenoid valve to an open position corresponds to a decoupling of a camshaft from the engine valves. A third example of the cylinder head optionally includes one or more of the first and second examples, and further includes, a low pressure oil gallery arranged vertically above, relative to the vertical direction, the engine valves and coupled to the engine valves by the pressure-generating medium. A fourth example of the cylinder head optionally includes one or more of the first through third examples, and further includes, wherein a pressure at the engine valves is decreased when the pressure-generating medium is flowed from the higher pressure reservoir to the lower pressure reservoir and the pressure at the engine valves is increased when the medium is flowed from the lower pressure reservoir to the higher pressure reservoir. A fifth example of the cylinder head optionally includes one or more of the first through fourth examples, and further includes, wherein the higher pressure reservoir is coupled to the engine valves by a hydraulic bridge. A sixth example of the cylinder head optionally includes one or more of the first through fifth examples, and further includes, wherein the valve actuators include a plurality of solenoid valves fluidly coupled to the higher pressure reservoir and to the engine valves. A seventh example of the cylinder head optionally includes one or more of the first through sixth examples, and further includes, wherein a geometry of the higher pressure reservoir at a lower edge of the higher pressure reservoir is similar to a geometry of the lower pressure reservoir at an upper edge of the lower pressure reservoir. An eighth example of the cylinder head optionally includes one or more of the first through seventh examples, and further includes, wherein the metering plate is positioned between the higher pressure reservoir and the lower pressure reservoir and configured to sealingly engage with the lower edge of the higher pressure reservoir and with the upper edge of the lower pressure reservoir.

In another example, an engine system includes an electro-hydraulic valve train with vertically stacked pressure reservoirs, the vertically stacked pressure reservoirs including a higher pressure reservoir and a lower pressure reservoir positioned directly above and below one another, a cylinder head having a plurality of engine valves actuated by the electro-hydraulic valve train and fluidly coupled to the higher pressure reservoir, and a hydraulic medium sealed within the vertically stack pressure reservoirs and adapted to be in fluid communication with the plurality of engine valves. In a first example of the system the electro-hydraulic valve train has a housing with a first portion, the first portion including integrated ports and chambers to house actuators of the electro-hydraulic valve train and a cavity for the higher pressure reservoir, and a second portion with a cavity for the lower pressure reservoir, the first portion arranged vertically above the second portion of the housing.

In another representation a housing for a valve train includes a first reservoir, holding a first pressure, coupled to a valve of the valve train and a second reservoir, holding a second pressure, coupled to the first reservoir, the second reservoir positioned vertically below the first reservoir, and a plurality of valve actuators arranged vertically above the first and the second reservoirs. In a first example of the housing, the first reservoir is also coupled to a solenoid valve and a piston pump. A second example of the housing optionally includes the first example, and further includes wherein the second reservoir is coupled to a pressure accumulator.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A variable valve actuation (VVA) assembly, comprising:

a plurality of actuators to adjust a lift height and duration of engine valves;

a plurality of upper cavities, having a first pressure, arranged vertically below a plurality of engine valve actuator ports and fluidly coupled to the plurality of actuators; and a plurality of lower cavities, having a second pressure, positioned directly below the plurality of upper cavities and coupled to the plurality of upper cavities by a feed.

2. The VVA assembly of claim 1, wherein the first pressure in the plurality of upper cavities is higher than the second pressure in the plurality of lower cavities.

3. The VVA assembly of claim 1, further comprising a metering plate arranged between the plurality of upper cavities and the plurality of lower cavities.

4. The VVA assembly of claim 3, wherein the metering plate is sandwiched between an upper portion of a housing of the VVA assembly that includes the plurality of upper cavities and a lower portion of the housing that includes the plurality of lower cavities.

5. The VVA assembly of claim 4, wherein the metering plate is fluidly impenetrable and seals an inner volume of the plurality of upper cavities from an inner volume of the plurality of lower cavities and wherein the metering plate includes an aperture aligned with the feed coupling the plurality of lower cavities to the plurality of upper cavities to allow fluid to flow continuously through the feed.

6. The VVA assembly of claim 4, wherein the plurality of upper cavities and the plurality of lower cavities are cavities in the housing of the VVA assembly and the housing is configured to couple to a cylinder head.

7. The VVA assembly of claim 6, wherein a width of the housing of the VVA assembly, the width perpendicular to a vertical axis of the VVA assembly, is defined by a width of the plurality of actuators arranged above the plurality of upper cavities.

8. The VVA assembly of claim 1, wherein the feed extends in a vertical direction from the plurality of upper cavities to the plurality of lower cavities and has at least one portion that extends vertically lower than a bottom surface of the plurality of lower cavities.

9. The VVA assembly of claim 1, wherein a housing of the VVA assembly includes an integrated low pressure oil gallery and an integrated high pressure oil gallery.

10. A cylinder head, comprising:

a variable valve actuation assembly having vertically stacked pressure reservoirs, including a first pressure reservoir with a first pressure and a second pressure reservoir with a second pressure, storing a pressure-generating medium and valve actuators fluidly coupled to the vertically stacked pressure reservoirs;

engine valve actuator ports positioned vertically above, relative to a direction of gravity, the pressure reservoirs; and engine valves configured to lift based on pressure communicated to the engine valves from the valve actuators.

11. The cylinder head of claim 10, wherein the first pressure reservoir is a higher pressure reservoir stacked above the second pressure reservoir, the second pressure reservoir being a lower pressure reservoir, and wherein the higher pressure reservoir is separated from the lower pressure reservoir by a metering plate.

12. The cylinder head of claim 11, wherein a pressure at the engine valves is decreased when the pressure-generating medium is flowed from the higher pressure reservoir to the lower pressure reservoir and the pressure at the engine valves is increased when the pressure-generating medium is flowed from the lower pressure reservoir to the higher pressure reservoir.

13. The cylinder head of claim 11, wherein the higher pressure reservoir is coupled to the engine valves by a hydraulic bridge.

14. The cylinder head of claim 13, wherein the valve actuators include a plurality of solenoid valves fluidly coupled to the higher pressure reservoir and to the engine valves.

15. The cylinder head of claim 14, wherein a length of the higher pressure reservoir at a lower region of the higher pressure reservoir is similar to a length of the lower pressure reservoir at an upper region of the lower pressure reservoir.

16. The cylinder head of claim 15, wherein the metering plate is positioned between the higher pressure reservoir and the lower pressure reservoir and configured to sealingly engage with the lower region of the higher pressure reservoir and with the upper region of the lower pressure reservoir.

17. The cylinder head of claim 10, wherein the valve actuators include a solenoid valve, and wherein actuation of the solenoid valve to an open position corresponds to a decoupling of a camshaft from the engine valves.

18. The cylinder head of claim 10, further comprising a low pressure oil gallery arranged vertically above, relative to a vertical direction, the engine valve actuator ports and coupled to the engine valves by the pressure-generating medium.

19. An engine system, comprising:

an electro-hydraulic valve train with vertically stacked pressure reservoirs, the vertically stacked pressure reservoirs including a higher pressure reservoir and a lower pressure reservoir positioned directly above and below one another;

a cylinder head having a plurality of engine valves actuated by the electro-hydraulic valve train, the plurality of engine valves fluidly coupled to the higher pressure reservoir, wherein the higher pressure reservoir is arranged vertically below a plurality of engine valve actuator ports; and a hydraulic medium sealed within the vertically stacked pressure reservoirs and adapted to be in fluid communication with the plurality of engine valves.

20. The engine system of claim 19, wherein the electro-hydraulic valve train has a housing with a first portion, the first portion including integrated ports and chambers to house actuators of the electro-hydraulic valve train and a cavity for the higher pressure reservoir, and a second portion with a cavity for the lower pressure reservoir, the first portion arranged vertically above the second portion of the housing.

* * * * *